US008159422B2

(12) United States Patent
Abe

(10) Patent No.: US 8,159,422 B2
(45) Date of Patent: Apr. 17, 2012

(54) LIGHT EMITTING DISPLAY DEVICE WITH FIRST AND SECOND TRANSISTOR FILMS AND CAPACITOR WITH LARGE CAPACITANCE VALUE

(75) Inventor: Katsumi Abe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 504 days.

(21) Appl. No.: 12/294,598

(22) PCT Filed: Aug. 24, 2007

(86) PCT No.: PCT/JP2007/066953

§ 371 (c)(1),
(2), (4) Date: Sep. 25, 2008

(87) PCT Pub. No.: WO2008/029717

PCT Pub. Date: Mar. 13, 2008

(65) Prior Publication Data

US 2009/0231241 A1 Sep. 17, 2009

(30) Foreign Application Priority Data

Sep. 5, 2006 (JP) ..... 2006-240257

(51) Int. Cl.
*G09G 3/30* (2006.01)

(52) U.S. Cl. ..... 345/76; 345/77; 345/92

(58) Field of Classification Search ..... 345/76–84, 345/204, 90, 92, 205, 211
See application file for complete search history.

(56) References Cited

U.S. PATENT DOCUMENTS 6,373,454 B1 4/2002 Knapp et al. ..... 345/76
6,501,466 B1 12/2002 Yamagishi et al. ..... 345/204
7,193,591 B2 * 3/2007 Yumoto ..... 345/82
2003/0062524 A1 * 4/2003 Kimura ..... 257/72
2003/0103022 A1 * 6/2003 Noguchi et al. ..... 345/77
2004/0041525 A1 * 3/2004 Park et al. ..... 315/169.3
2004/0222950 A1 * 11/2004 Kimura ..... 345/76
2005/0093804 A1 * 5/2005 Yamazaki et al. ..... 345/92
2005/0180083 A1 8/2005 Takahara et al. ..... 361/152
2005/0285823 A1 * 12/2005 Kimura et al. ..... 345/76
2006/0110867 A1 * 5/2006 Yabuta et al. ..... 438/151
2006/0125408 A1 * 6/2006 Nathan et al. ..... 315/169.3
2007/0273622 A1 * 11/2007 Huang ..... 345/76
2009/0045399 A1 * 2/2009 Kaji et al. ..... 257/43

OTHER PUBLICATIONS

Nathan et al., "P-26: Amorphous Silicon Enables Large AMOLED Displays for HDTV," *SID 05 Digest*, pp. 320-323 (2005). Nathan et al., "46.1:Invited Paper: a-Si for AMOLED—Meeting the Performance and Cost Demands of Display Applications (Cell Phone to HDTV)," *SID 06 Digest*, pp. 1543-1546 (2006).

* cited by examiner

*Primary Examiner* — Alexander S Beck
*Assistant Examiner* — Charles Zheng
(74) *Attorney, Agent, or Firm* — Fitzpatrick, Cella, Harper & Scinto

(57) ABSTRACT

A light emitting display device using a drive circuit formed of only unipolar thin film transistors, which suppresses effects of characteristic shifts of transistors, and is applicable to large, high-resolution light emitting displays. The device includes a pixel having an organic EL device (LED) and a drive circuit thereof. In a current writing period, the drive circuit sets TFT3, TFT4 and TFT5 ON and sets a ground line and one end of LED to the same voltage through TFT3. A current from a data line is supplied to transistors L-TFT and D-TFT forming a current mirror circuit through TFT4 and TFT5, and a voltage between gate and source terminals of L-TFT and D-TFT is retained in a capacitor. During a LED driving period, TFT3, TFT4 and TFT5 are interrupted, and a current flowing between the source and drain of D-TFT is supplied to LED according to the retaining voltage.

16 Claims, 9 Drawing Sheets

T1; CURRENT WRITING PERIOD

T2; LED DRIVING (LIGHT EMITTING) PERIOD

T11; CURRENT WRITING PERIOD

T21; LED DRIVING (LIGHT EMITTING) PERIOD

T22; DARK DISPLAYING PERIOD

T11; CURRENT WRITING PERIOD

T21; LED DRIVING (LIGHT EMITTING) PERIOD

T22; DARK DISPLAYING PERIOD

LIGHT EMITTING DISPLAY DEVICE WITH FIRST AND SECOND TRANSISTOR FILMS AND CAPACITOR WITH LARGE CAPACITANCE VALUE

TECHNICAL FIELD

The present invention relates to a current load device which achieves a function thereof according to a current to be supplied, and more particularly, to a light emitting display device using a light emitting device as a current load. In particular, the present invention relates to a light emitting display device including a plurality of pixels formed in a matrix form, each of which is comprised of an organic electro-luminescence (hereinafter, referred to as "EL") device serving as a light emitting device, and a drive circuit for supplying a current to the organic EL device.

BACKGROUND ART

An organic EL device is a light emitting device which emits light when a current passes therethrough as in a light emitting diode (LED), and is also called an organic LED (OLED). For the light emitting display device including a plurality of pixels formed in a matrix form, each of which is comprised of the organic EL device and the drive circuit for driving the organic EL device, an active-matrix (hereinafter, referred to as "AM")-type organic EL display has been studied.

FIG. 6 illustrates a configuration example of pixels of the AM-type organic EL display. In FIG. 6, reference symbol LED denotes an organic EL device, reference numeral 101 denotes a drive circuit, reference symbol DL denotes a data line, and reference numeral SL denotes a scan line. FIG. 7 illustrates a configuration example of the AM-type organic EL display in which a plurality of pixels is arranged in a matrix form (n columns×m rows). In FIG. 7, reference symbols SL1 to SLm each denote a scan line which is arranged for each row of the first to m-th rows, and reference symbols DL1 to DLn each denote a data line which is arranged for each column of the first to n-th columns. An AM-type organic EL display 100 illustrated in FIG. 7 controls, for each pixel, voltages and currents to be supplied from drive circuits 101 to the organic EL device LEDs through the data lines DL for each column, times, and the like, in response to signals (H level or L level) of the scan lines SL for each row. Through this control, luminance of the organic EL device LED is adjusted, and gradation display thereof is performed.

In the AM-type organic EL display as described above, in a case where the voltage-luminance characteristic of the organic EL device changes over time, the display quality is affected. This also applies to a case where there is variation in characteristics of a thin film transistor (hereinafter, referred to as "TFT") which is a component of a drive circuit, and a case where the characteristics of the TFT are changed due to an electrical stress to be applied. Accordingly, in order to achieve high-quality display without unevenness, it is necessary to develop a drive circuit and drive method, which is hardly affected by a temporal change of the characteristics of the organic EL device or by the variation and change in characteristics of the TFT.

(Prior Art 1)

FIG. 8 illustrates a simplest drive circuit as a first prior art. In FIG. 8, reference symbol LED denotes an organic EL device, reference numeral 101 denotes a drive circuit, reference symbol DL denotes a data line, reference symbol SL denotes a scan line, reference symbol VS denotes a power supply line, reference symbol GND denotes a ground line, reference symbol D-TFT denotes a driving p-type TFT, and reference symbol C denotes a capacitor. An on/off operation of a switch (switching element) SW1 is controlled in response to the signal of the scan line SL.

In this prior art, the switch SW1 is turned on in response to the signal of a scan line SL, and a voltage from the data line DL is applied to a gate terminal of the TFT (D-TFT), which is provided within the drive circuit 101, through the switch SW1, thereby retaining a voltage between the gate terminal and a source terminal in the capacitor C. The TFT supplies a current to the organic EL device LED according to the voltage applied to the gate terminal. In this prior art, the change in the OLED luminescence is small since the time variation in the current-luminance characteristic of the OLED device is smaller than the voltage-luminance characteristics. On the other hand, when there is variation in characteristics of the TFT, the current supplied to the organic EL device LED varies, whereby display unevenness appears. In the prior art, some drive circuits have been proposed in order to solve the above-mentioned problem. In the following description, prior art examples of those drive circuits will be described.

(Prior Art 2)

FIG. 9 illustrates a drive circuit disclosed in U.S. Pat. No. 6,373,454 as a second prior art. In FIG. 9, reference symbol LED denotes an organic EL device, reference numeral 101 denotes a drive circuit, reference symbol DL denotes a data line, reference symbols SLA and SLB each denote a scan line, reference symbol VS denotes a power supply line, reference symbol GND denotes a ground line, reference symbol D-TFT denotes a driving p-type TFT, and reference symbol C denotes a capacitor. An on/off operation of each of switches (switching elements) SW1, SW2, and SW3 is controlled in response to the signal of the scan lines SL.

In this prior art, the switches SW1 and SW2 are turned on in response to the signal of the scan line SLA, and a current is supplied from the outside (data line DL) through the switch SW1 to the TFT (D-TFT) provided within the drive circuit 101, in which a short circuit between the gate terminal and the drain terminal is formed through the switch SW2. As a result, the voltage at the gate terminal of the TFT can be set as a voltage at which the current flows from the outside according to the threshold and the mobility of the TFT. Then, when the switch SW3 is turned on in response to the signal of the scan line SLB, the TFT serves as a current source and is capable of passing the current having the same intensity as that from the outside to the organic EL device LED through the switch SW3. Accordingly, if the current from the outside does not vary, according to this prior art, it is possible to cause a constant current to flow through the organic EL device and perform display without unevenness irrespective of the characteristic variation of the TFT.

(Prior Art 3)

FIG. 10 illustrates a drive circuit disclosed in U.S. Pat. No. 6,501,466 as a third prior art. In FIG. 10, reference symbol LED denotes an organic EL device, reference numeral 101 denotes a drive circuit, reference symbol DL denotes a data line, reference symbol SL denotes a scan line, reference symbol VS denotes a power supply line, reference symbol GND denotes a ground line, reference symbols L-TFT and D-TFT denote a pair of p-type TFTs forming a current mirror circuit, and reference symbol C denotes a capacitor. An on/off operation of each of switches (switching elements) SW1 and SW2 is controlled in response to the signal of the scan line SL.

According to this prior art, the switches SW1 and SW2 are turned on in response to the signal of the scan line SL, the gate terminal and the drain terminal of one TFT (L-TFT) are short-circuited through the switch SW2, and a current is supplied from the outside (data line DL) through the switch SW1. As a result, the voltage at the gate terminal of the L-TFT can be set as a voltage with which the current flows from the outside. With this configuration, the other TFT (D-TFT) of the prior art TFTs supplies a current to the organic EL device LED according to the voltage. The two TFTs forming the current mirror circuit are positioned closer to each other and there is a small variation in characteristics therebetween, so the current supplied to the organic EL device LED is determined based on the current from the outside and the current capability ratio between the L-TFT and the D-TFT. Accordingly, if the current from the outside does not vary, according to this prior art, it is possible to cause a constant current to flow through the organic EL device and perform display without unevenness irrespective of the variation in characteristics of the TFTs.

For the above-mentioned circuit, a TFT having a channel layer made of a polycrystal-Si (hereinafter, referred to as "p-Si"), amorphous silicon (hereinafter, referred to as "a-Si"), an organic semiconductor (hereinafter, referred to as "OS"), or the like has been studied. The p-Si TFT can be produced with a high mobility at low working voltage, but manufacturing costs therefor are high. On the other hand, the a-Si TFT or the OS TFT can be produced at low cost with a small number of manufacturing steps, but requires a high working voltage and large power consumption because the a-Si and OS the TFT have a lower mobility than the p-Si TFT. Further, a TFT using a metal oxide semiconductor such as ZnO as the channel layer has been developed in recent years, and it is reported that such a TFT has a higher mobility than the a-Si TFT and the OS TFT.

It is difficult for the TFT having the channel layer made of a-Si, an OS, or a metal oxide semiconductor to be of a complementary TFT in which an n-type TFT and a p-type TFT are formed on the same substrate. For example, a p-type semiconductor having a high mobility has not been obtained with a-Si or a metal oxide, so it is difficult to form a p-type TFT. In addition, with regard to the OS, the n-type semiconductor and the p-type semiconductor that have a high mobility are made of different materials, which requires twice as many processes and makes it difficult to manufacture the TFT at low costs. Accordingly, it is necessary that the drive circuit using those TFTs is formed of only the n-type TFT or the p-type TFT.

Further, it is known that the TFT having the channel layer made of a-Si, an OS, or a metal oxide has a current-voltage characteristic which can shift according to the voltage to be applied between the gate terminal and the source terminal.

In the above description, the a-Si TFT is used for a pixel of an AM-type liquid crystal display (hereinafter, referred to as "LCD") and a production technology therefor with a diagonal size of several ten inches is established. For this reason, the a-Si TFT is regarded as a promising TFT for a drive circuit of a large AM-type organic EL display having a diagonal size of 10 inches or larger, and technology development has been promoted (see fourth prior art as illustrated in FIG. 11 to be described later).

On the other hand, the organic EL device generally has a configuration in which at least a light emitting layer made of an organic material which is sandwiched between an anode electrode and a cathode electrode. The organic material is affected by heat, electromagnetic wave, water, and the like, so characteristics thereof are liable to be changed. For this reason, for a light emitting display device using the organic EL device, it is desirable to use a manufacturing process in which the light emitting layer made of the organic material is formed after formation of the drive circuit and the anode electrode, and then the cathode electrode is formed by vacuum deposition or the like which causes less damage.

According to the above-mentioned process, it is considered a case where each pixel of the AM-type organic EL display includes a drive circuit formed of an n-type TFT, and an organic EL device having an anode electrode, an organic light emitting layer, and a cathode electrode that are formed in the stated order from the bottom. In this case, functions disclosed in U.S. Pat. No. 6,373,454 and U.S. Pat. No. 6,501,466 cannot be achieved only by replacing the p-type TFT with the n-type TFT. This is because, in U.S. Pat. No. 6,373,454 and U.S. Pat. No. 6,501,466, the source terminal voltage of the p-type TFT is fixed by a power supply, and the gate terminal voltage is determined based on the current from the outside. For this reason, at the time of driving the organic EL device, the voltage difference between the gate terminal and the source terminal is fixed, which functions as a constant current source with respect to the organic EL device. In this case, when the p-type TFT is replaced with the n-type TFT, the voltage between the gate terminal and the drain terminal is fixed, which does not function as a constant current source. Further, as described above, the characteristic shift due to the applied voltage is caused, so it is necessary to suppress the influence of the characteristic shift.

(Prior Art 4)

A fourth prior art is a prior art for solving the above-mentioned problem with the drive circuit using an a-Si TFT. FIG. 11 illustrates a drive circuit disclosed in A. Nathan et al. (SID 05 DIGEST, p. 26, FIG. 3) and A. Nathan et al. (SID 06 DIGEST, 46.1, FIG. 1). In FIG. 11, reference symbol LED denotes an organic EL device, reference numeral 101 denotes a drive circuit, reference symbol DL denotes a data line, reference symbol SL denotes a scan line, reference symbol VS denotes a power supply line, reference symbol GND denotes a ground line, reference symbols L-TFT and D-TFT denote a pair of n-type TFTs forming a current mirror circuit, and reference symbol C denotes a capacitor. An on/off operation of each of switches (switching elements) SW1 and SW 2 is controlled in response to the signal of the scan line SL.

In this prior art, the current mirror circuit disclosed in U.S. Pat. No. 6,501,466 is applied. According to this prior art, the switches SW1 and SW2 are turned on in response to the signal of the scan line SL, the gate terminal and the drain terminal of the L-TFT are connected to each other through the switch SW2, and a current is supplied from the outside (data line DL) through the switch SW1. Then, the supplied current flows from the drain terminal of the L-TFT to the source terminal thereof and further to the organic EL device LED. Accordingly, the voltages at the gate terminal and the source terminal of the L-TFT become a voltage with which the current flows from the outside. In addition, the D-TFT has a common gate terminal and source terminal with the L-TFT, so the D-TFT supplies the current to the organic EL device LED according to the gate terminal voltage and the source terminal voltage of the L-TFT. By retaining the gate terminal voltage in the capacitor C, the D-TFT can supply a current which is the same as the current obtained during a period in which the current is supplied from the outside, even in a period in which the current from the outside is stopped.

In addition, during the operation, the gate terminals and the source terminals of the D-TFT and the L-TFT are supplied with the same voltage, and the characteristic shifts of the TFTs become the same. At this time, the current capability ratio between the D-TFT and the L-TFT is retained. In this case, even when the characteristic shift is caused, the current flowing through those TFTs can be made comparable to the current obtained before the characteristic shift is caused.

Note that, in this prior art, it is necessary for the L-TFT to have sufficiently low capability for causing the current to flow, as compared with the D-TFT. This is because the organic EL device is supplied with a current from the L-TFT and the D-TFT during a period in which a current from the outside is supplied, while during a period in which the current from the outside is stopped, the organic EL device is supplied with a current only from the D-TFT. Accordingly, in both periods, the source voltages of the L-TFT and the D-TFT which are determined based on the current capability of the organic EL device do not match with each other when a current value of the L-TFT is larger than that of the D-TFT. In this case, the current set during the period in which the current from the outside is supplied cannot be caused to flow during the period in which the current from the outside is stopped. As a result, it is necessary that the current supplied to the L-TFT from the outside is made smaller than the current supplied by the D-TFT to the organic EL device.

On the other hand, in recent years, the current-luminance characteristic of the organic EL device has been improved, and the current supplied to the organic EL device has been lowered. In addition, there is a demand for a larger and higher-definition organic EL display, and a line load tends to be increased. Therefore, in the prior arts particularly in a case of supplying a low current corresponding to low gradation from the outside, a long time is necessary for charging the line load. In this case, it takes a long time to perform an operation for setting the voltage at the gate terminal of the TFT provided within the drive circuit to be equal to the voltage at which the current from the outside flows, according to the threshold and the mobility of the TFT, which makes it difficult to apply the organic EL device to a display device with high-resolution and a large screen. In order to overcome the difficulty, a unit for increasing the current from the outside may be employed, but the unit cannot be applied to the fourth prior art as described above.

DISCLOSURE OF THE INVENTION

It is an object of the present invention to provide a light emitting display device using a drive circuit comprised of only unipolar thin film transistors, which is capable of suppressing an effect of characteristic shifts of the thin film transistors due to an applied voltage, and is capable of being applied to a large and high-resolution light emitting display device.

In order to attain the above-mentioned object, according to a first aspect of the present invention, there is provided a light emitting display device including a pixel having a light emitting device and a drive circuit for driving the light emitting device. The drive circuit includes a first thin film transistor, a second thin film transistor, a first switch, and a capacitor.

A gate terminal of the first thin film transistor is connected to a gate terminal of the second thin film transistor, and a source terminal of the first thin film transistor is connected to a source terminal of the second thin film transistor. The source terminals are connected to one end of the light emitting device, and the first thin film transistor and the second thin film transistor have the same polarity. In addition, the first switch has one end connected to the source terminals of the first thin film transistor and the second thin film transistor and to one end of the light emitting device and has the other end connected to a first line. Further, the capacitor has one end connected to the gate terminals of the first thin film transistor and the second thin film transistor and has the other end connected to the source terminals of the first thin film transistor and the second thin film transistor. A second line supplies a drive signal to the light emitting device.

The drive circuit has at least a first period for writing the drive signal and a second period for driving the light emitting device after the first period.

The first period contains a period in which the first line and one end of the light emitting device are set to the same voltage through the first switch, and a second line is electrically connected to the drain terminal of the first thin film transistor and the gate terminals of the first thin film transistor and the second thin film transistor to thereby supply a current to the first thin film transistor from the second line.

The second period contains a period in which connection between the second line and the first thin film transistor, connection between the second line and the second thin film transistor, and the first switch are shut off.

Further, in order to attain the above-mentioned object, according to a second aspect of the present invention, there is provided a light emitting display device including a pixel having a light emitting device and a drive circuit for driving the light emitting device. The drive circuit includes a first thin film transistor, a second thin film transistor, a first switch, and a capacitor.

A gate terminal of the first thin film transistor is connected to a gate terminal of the second thin film transistor, and a source terminal of the first thin film transistor is connected to a source terminal of the second thin film transistor. The source terminals are connected to one end of the light emitting device, and the first thin film transistor and the second thin film transistor have the same polarity. In addition, the first switch has one end connected to the source terminals of the first thin film transistor and the second thin film transistor and to one end of the light emitting device and has the other end connected to a first line. Further, the capacitor has one end connected to the gate terminals of the first thin film transistor and the second thin film transistor and has the other end connected to the source terminals of the first thin film transistor and the second thin film transistor. A second line supplies a drive signal to the light emitting device.

The drive circuit has at least a first period for writing the drive signal and a second period for driving the light emitting device after the first period.

During the first period, the driving circuit sets the first line and one end of the light emitting device to the same voltage through the first switch and supplies a current from the second line to the drain terminal of the first thin film transistor and the gate terminals of the first thin film transistor and the second thin film transistor to thereby retain in the capacitor a voltage between the gate terminal and the source terminal of the second thin film transistor which is determined based on a current flowing between the drain terminal and the source terminal of the first thin film transistor.

Further, during the second period, the drive circuit supplies to the light emitting device a current flowing between the source terminal and the drain terminal of the second thin film transistor according to the retaining voltage of the capacitor.

According to the present invention, each pixel has a drive circuit including a current mirror circuit formed of a pair of thin film transistors having the same polarity. The pair of thin film transistors have a common source terminal connected to one end of the light emitting device and connected to the first line through the first switch, and there is provided a capacitor between the gate terminal and the source terminal. With this configuration, it is possible to provide a light emitting display device using a drive circuit comprised of only unipolar thin film transistors, which is capable of suppressing the effect of the characteristic shifts of the thin film transistors due to the applied voltage, and is capable of being applied to a large and high-resolution light emitting display device.

Further features of the present invention will become apparent from the following description of exemplary embodiments with reference to the attached drawings.

BEST MODE FOR CARRYING OUT THE INVENTION

Figure 1:
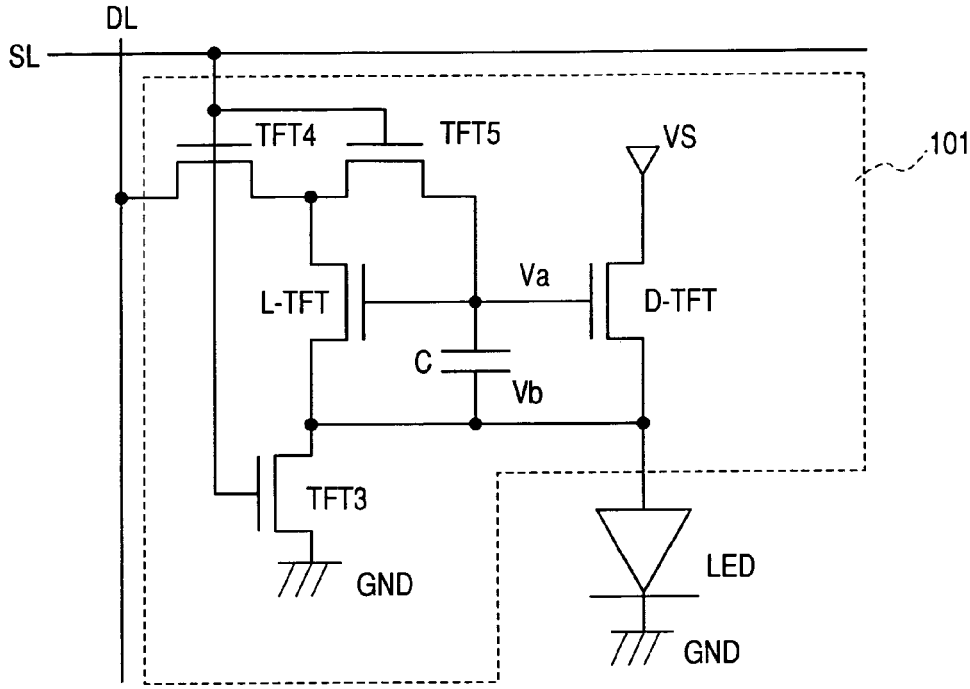
FIG. 1 is a circuit diagram for illustrating a configuration of a pixel of a light emitting display device according to Example 1 of the present invention.

Hereinafter, exemplary embodiments of the present invention will be described with reference to the drawings.

In an embodiment of the present invention, a light emitting display device using an organic EL device will be described, but the present invention can also be applied to a light emitting display device other than the organic EL device, which emits light with a supplied current, and to a current load device using a normal current load which indicates an arbitrary function for a supplied current. In addition, in the embodiment, an n-type TFT is described. Alternatively, as described later, it is possible to employ a p-type TFT, instead of the n-type TFT, with an anode terminal of the organic EL device being replaced with a cathode terminal.

The light emitting device according to the embodiment has a pixel which includes at least an organic EL device whose luminance is determined based on a supplied current, and a drive circuit for supplying a constant current to the organic EL device.

The organic EL device is also called "OLED" as described above and can afford a planar self-emitting light capable of emitting light at high luminance. The organic EL device enables light emission at low voltage and with high efficiency by laminating organic layers serving as a light emitting layer between an anode electrode and a cathode electrode according to functions thereof and by increasing the number of functional laminated layers of the organic layers. A basic configuration of the organic EL device is such that the organic EL device includes an EL light emitting layer comprised of organic layers and a hole transport layer between an anode electrode and a cathode electrode to form an anode electrode/hole transport layer/EL light emitting layer/cathode electrode laminated structure. In the light emitting display device using the organic EL device as the light emitting device, light emitting luminance is controlled through injection of holes and electrons into the light emitting layer. It should be noted that the organic EL device is a known matter, so a detailed description thereof will be omitted.

A light emitting display device according to the present invention will be described with reference to FIGS. 1 and 2.

The light emitting display device according to the present invention has a pixel including a light emitting device and a drive circuit 101 for driving the light emitting device. The drive circuit 101 includes a first thin film transistor L-TFT, a second thin film transistor D-TFT, a first switch TFT3, a capacitor C, and a first line GND.

The first thin film transistor and the second thin film transistor (L-TFT and D-TFT) have gate terminals connected to each other and source terminals connected to each other, and the source terminals are connected to one end (anode terminal) of the light emitting device. In this case, the first thin film transistor and the second thin film transistor (L-TFT and D-TFT) have the same polarity.

Further, the first switch TFT3 has one end connected to the source terminals of the first thin film transistor and the second thin film transistor (L-TFT and D-TFT) and one end (anode terminal) of the light emitting device and has the other end connected to the first line GND.

Further, the capacitor C has one end connected to the gate terminals of the first thin film transistor and the second thin film transistor (L-TFT and D-TFT) and has the other end connected to the source terminals of the first thin film transistor and the second thin film transistor. A second line DL supplies a drive signal of the light emitting device.

Then, the drive circuit according to the present invention has at least a first period (T1 of FIG. 2) for writing the drive signal and a second period (T2 of FIG. 2) for driving the light emitting device after the first period.

During the first period (T1), the drive circuit sets the first line and one end (anode terminal) of the light emitting device to the same voltage through the first switch TFT3. In addition, during the first period (T1), the drive circuit electrically connects the second line DL to the drain terminal of the first thin film transistor and the gate terminals of the first thin film transistor and the second thin film transistor to thereby supply a current from the second line to the first thin film transistor. The first period (T1) contains a period for performing the above-mentioned operations.

Figure 2:
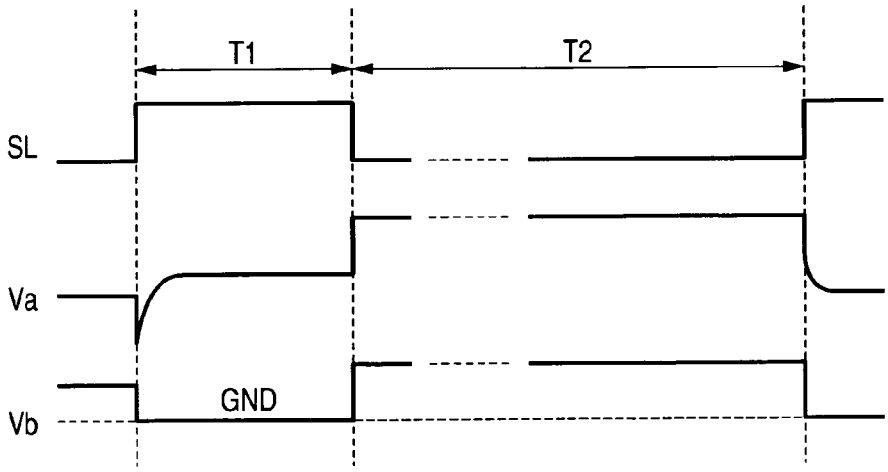
FIG. 2 is a timing chart illustrating an operation of the light emitting display device according to Example 1.

In this case, when connecting the second line to the drain terminal of the first thin film transistor and the gate terminals of the first thin film transistor and the second thin film transistor, a second switch TFT4 and a third switch TFT5 may be used as illustrated in FIG. 1.

In other words, it is possible to use the second switch TFT4 having one end connected to the second line and the other end connected to the drain terminal of the L-TFT and the third switch TFT5 having one end connected to the drain terminal of the L-TFT and the other end connected to the gate terminal of the L-TFT.

In addition, in this case, the drain terminal of the third switch TFT5 may be directly connected to the second line DL.

The second period (T2) contains a period for shutting off the connection between the second line and the first thin film transistor, connection between the second line and the second thin film transistor, and the first switch.

Through the operations during the above-mentioned first period and second period, the drive circuit performs the following operations.

During the first period (T1), the drive circuit sets the first line and one end of the light emitting device to the same voltage through the first switch TFT3. Further, the drive circuit supplies a current from the second line DL to the drain terminal of the first thin film transistor and the gate terminals of the first thin film transistor and the second thin film transistor. As a result, it is possible to retain, in the capacitor C, the voltage between the gate terminal and the source terminal of the second thin film transistor, which is determined based on the current flowing between the drain terminal and the source terminal of the first thin film transistor.

Further, during the second period (T2), the drive circuit supplies to the light emitting device a current flowing between the source terminal and the drain terminal of the second thin film transistor, according to a retaining voltage of the capacitor. In this case, the retaining voltage of the capacitor corresponds to a potential difference between Va and Vb. In addition, the current supplied to the light emitting device is supplied from a power supply line VS.

More desirably, in the light emitting display device according to the embodiment, the value (W/L) obtained by dividing the channel width of the L-TFT by the channel length thereof is equal to the value W/L of the D-TFT, or the value W/L of the L-TFT is larger than the value W/L of the D-TFT. As a result, it is possible to define the size ratio between a pair of L-TFT and D-TFT that form a current mirror circuit.

More desirably, in the light emitting display device according to the embodiment, the capacitance value of the capacitor is three times or more as large as the total capacitance value obtained by adding the channel capacitance and the gate-drain overlap capacitance of the L-TFT and the channel capacitance and the gate-drain overlap capacitance of the D-TFT. As a result, it is possible to define the size of the capacitance.

More desirably, in the light emitting display device according to the embodiment, the voltage of the first line is equal to or lower than a working voltage of the organic EL device. As a result, it is possible to interrupt the drive current flowing to the organic EL device at the time of current writing.

More desirably, the light emitting display device according to the embodiment includes a drive circuit which does not allow current to flow between the source and the drain of the D-TFT during the period in which at least first to third switches are made conductive (ON period; first period). As a result, it is possible to interrupt the drive current flowing through the organic EL device at the time of current writing.

More desirably, the light emitting display device according to the embodiment includes, as the drive circuit which does not allow current to flow between the source and the drain of the D-TFT, a circuit which sets the drain terminal voltage of the D-TFT to the voltage of the first line during the period in which the first to third switches are in the ON state. As a result, the drive current flowing through the organic EL device is interrupted by the change in the power supply voltage that corresponds to the drain terminal voltage of the D-TFT. Alternatively, the light emitting display device according to the embodiment includes a fourth switch between the drain terminal of the D-TFT and the third line (or a power supply). The fourth switch includes at least a drive circuit (current breaker) which conducts interruption, or turning-off, during the period in which at least the first to third switches are in the ON state. Through the fourth switch, it is possible to interrupt the drive current flowing through the organic EL device.

More desirably, the light emitting display device according to the embodiment includes a drive circuit which provides a period in which a current is not caused to flow between the source and the drain of the D-TFT (third period) in at least a part of the period in which the first to third switches are shut off (OFF period; second period). The drive circuit is characterized by using the change in a power supply voltage or the fourth switch. As a result, it is possible to interrupt the drive current flowing to the organic EL device during the third period.

More desirably, in the light emitting display device according to the embodiment, the first to third switches are each formed of an n-type TFT (hereinafter, referred to as "third to fifth n-type TFTS") which have the same configuration as the L-TFT and the D-TFT. In the third to fifth n-type TFTs, one of the source terminal and the drain terminal thereof functions as one end of each switch, and the other of the source terminal and the drain terminal functions as the other end of each switch. As a result, the first to third switches can be formed of the TFT having the same configuration as the L-TFT and the D-TFT.

More desirably, the light emitting display device according to the embodiment is characterized in that the gate terminals of the third to fifth n-type TFTs are connected to the fourth line. As a result, it is possible to perform common control of TFTs forming the switches.

More desirably, in the light emitting display device according to the embodiment, the fourth switch is formed of an n-type TFT (hereinafter, referred to as "sixth n-type TFT") which has the same configuration as the L-TFT, the D-TFT, and the third to fifth n-type TFTs. In the sixth n-type TFT, one of the source terminal and the drain terminal functions as one end of the switch, and the other of the source terminal and the drain terminal functions as the other end of the switch. As a result, the fourth switch is formed of the TFT having the same configuration as the L-TFT, the D-TFT, and the first to third switches.

More desirably, in the light emitting display device according to the embodiment, the TFTs constituting the drive circuit each have an n-type semiconductor film made of an amorphous metal oxide having a carrier density of $10^{18}$ [$cm^{-3}$] or lower, as an n-type TFT channel film of the n-type TFT. The film has a mobility of 1 [$cm^2/Vs$] or more, and an on/off ratio of $10^6$ or more. As a result, as the TFT forming the drive circuit, the TFT using an oxide semiconductor as a channel film can be used.

More desirably, in the light emitting display device according to the embodiment, any one of the above-mentioned drive circuits is employed as the drive circuit, and plural drive circuits are formed on the substrate in a matrix form.

According to the drive circuit of the embodiment, during the period in which a current is supplied from the outside and a current which is caused to flow through the pair of n-type TFTs (L-TFT and D-TFT) which form the current mirror circuit is set, no current flows because the voltage between the cathode terminal and the anode terminal of the organic EL device becomes equal to or lower than the working voltage. In addition, the voltage between the gate terminal and the source terminal at which the current supplied from the outside flows is retained in the L-TFT and the D-TFT. Accordingly, the D-TFT functions as a constant current source as long as the D-TFT operates in a saturation region. In addition, the capacitance is sufficiently larger than the parasitic capacitance such as the overlap capacitance, so it is possible to ignore the effect of the parasitic capacitance even when the voltage at the source terminal, the drain terminal, or the like is fluctuated.

Further, according to the embodiment, during the period for supplying current to the organic EL device, the voltages at the drain terminal and the source terminal of the L-TFT become equal to the voltage of the source terminal of the D-TFT, and the voltages at the gate terminal and the source terminal of each of the L-TFT and the D-TFT are equal to each other. Accordingly, it is possible to set a characteristic change due to an applied voltage to be equal between the L-TFT and the D-TFT.

Further, according to the embodiment, by setting the current capability of the L-TFT to be larger than that of the D-TFT, it is possible to make the current supplied from the outside to the L-TFT larger than the current supplied to the organic EL device by the D-TFT. Accordingly, the present invention can also be applied to a large and high-resolution display. In addition, according to the embodiment, as described above, during the period for setting the current, the current is not caused to flow through the organic EL device. Therefore, even when the current supplied from the outside is large, no large current is caused to flow through the organic EL device. As a result, during the current setting period, degradation of the organic EL device due to the large current can be suppressed, and there is no need to set the voltages necessary at the time of current setting to be higher.

Further, according to the embodiment, during the period in which a current is supplied from the outside and a current caused to flow through the current mirror n-type TFTs (L-TFT and D-TFT) is set, the current flowing through the D-TFT can be stopped. In addition, if this function is used before and after the period in which the current is supplied to the organic EL device, that is, the organic EL device emits light, or only before the period, or only after the period, it is possible to provide a period for stopping light emission of the organic EL device without causing the current to flow through the D-TFT. When the period for stopping the light emission is provided in this manner, in order to achieve the same time-average luminance as that of a case where the period for stopping the light emission is not provided, the current supplied to the organic EL device is increased. This corresponds to increasing the current supplied from the outside, and thus, the present invention can also be applied to a large and high-resolution display. In addition, by providing the period for stopping the light emission, a similar function to that of a cathode ray tube (CRT) is obtained, and a high-quality dynamic image display with less afterimages can be achieved.

Further, according to the embodiment, as the n-type TFT, an n-type TFT using a semiconductor layer made of an amorphous metal oxide having a carrier density of $10^{18}$ [$cm^{-3}$] or lower and a field effect mobility of 1 [$cm^2/Vs$] or more as the channel layer is used. As a result, as compared with a case of constituting the light emitting display device using an a-Si TFT or an OS TFT, the light emitting display device using the TFT, capable of being formed at room temperature, with less power consumption can be produced. In addition, the light emitting device has a high mobility, so it is possible to achieve a high-resolution and large screen.

As described above, according to the embodiment, in the light emitting display device using the organic EL device, it is possible to provide a drive circuit for the organic EL device in which an anode electrode, an organic material light emitting layer, and a cathode electrode are laminated in the stated order from the bottom on the drive circuit. The drive circuit can be comprised of an n-type TFT using a-Si, OS, or a metal oxide semiconductor as the channel layer. Further, it is possible to provide a drive circuit capable of suppressing the effect of the characteristic shift of the TFT caused by the applied voltage. In addition, it is possible to provide a drive circuit capable of being applied to a large and high-resolution light emitting display device.

Hereinafter, various examples of the light emitting display device using the organic EL device will be described. However, the present invention is not limited to the organic EL device, and can also be applied to other current loads. Further, in the following description, an n-type TFT using an amorphous metal oxide semiconductor as the channel layer is used, but the present invention can also be applied to an a-Si TFT and an OS TFT. In addition, the present invention can also be applied to a light emitting display device which is formed of only an n-type TFT having a channel layer made of another semiconductor material.

EXAMPLE 1

First, Example 1 of the present invention will be described.

A configuration of this example is illustrated in FIG. 1. The light emitting display device illustrated in FIG. 1 is an organic EL display device (AM-type organic EL display) including pixels each having an organic EL device LED having a cathode terminal connected (grounded) to a ground line GND, and a drive circuit 101 for driving the organic EL device LED.

The organic EL device LED has an anode electrode, an organic material light emitting layer and a cathode electrode, which are laminated in the stated order from the bottom.

The drive circuit 101 includes a first n-type TFT (hereinafter, referred to as "L-TFT"), a second n-type TFT (hereinafter, referred to as "D-TFT"), a third n-type TFT (hereinafter, referred to as "TFT3"), a fourth n-type TFT (hereinafter, referred to as "TFT4"), a fifth n-type TFT (hereinafter, referred to as "TFT5"), and a capacitor C. The L-TFT and the D-TFT are each formed of an n-type TFT forming a current mirror circuit (n-type current mirror TFT), and the TFT3, the TFT4, and the TFT5 are each formed of an n-type TFT forming a switch (switching element) (n-type switching TFT).

In the drive circuit 101, there are arranged lines such as a data line DL for supplying to the L-TFT a current which corresponds to display gradation of a pixel, a scan line SL connected to each gate terminal of the TFT3, the TFT4, and the TFT5, a power supply line VS, and a ground line GND. The ground line GND corresponds to the first line of the present invention, the data line DL corresponds to the second line of the present invention, the power supply line VS corresponds to the third line of the present invention, and the scan line SL corresponds to the fourth line of the present invention, respectively.

The L-TFT has a source terminal connected to the anode terminal of the organic EL device LED, and a gate terminal connected to one end of the capacitor C. The L-TFT corresponds to the first thin film transistor forming the current mirror circuit of the present invention.

The D-TFT has a source terminal connected to the anode terminal of the organic EL device LED, and a gate terminal connected to one end of the capacitor C, and a drain terminal connected to the power supply line VS. The D-TFT corresponds to the second thin film transistor forming the current mirror circuit of the present invention.

The TFT3 has source and drain terminals, one of the source and drain terminals being connected to the anode terminal of the organic EL device LED, and the other of the source and drain terminals being connected (grounded) to the ground line GND. The TFT3 corresponds to the first switch of the present invention.

The TFT4 has source and drain terminals, one of the source and drain terminals being connected to the data line DL and the other of the source and drain terminals being connected to the drain terminal of the L-TFT. The TFT4 corresponds to the second switch of the present invention.

The TFT5 has source and drain terminals, one of the source and drain terminals being connected to the drain terminal of the L-TFT, and the other of the source and drain terminals being connected to the gate terminal of the L-TFT. The TFT5 corresponds to the third switch of the present invention.

The capacitor C has one end connected to the gate terminals of the L-TFT and the D-TFT, and the other end connected to the source terminals of the L-TFT and the D-TFT. In addition, the other end of the capacitor C is connected to the anode terminal of the organic EL device LED.

In this case, the voltage of the power supply line VS is set to a voltage VD at which the D-TFT operates in the saturation region even in a case where the current set during the current writing period to be described later is caused to flow through the D-TFT and the organic EL device LED.

Further, the current capability of the L-TFT is assumed to be 4 times as large as that of the D-TFT. This can be realized by setting the channel length of the L-TFT to be equal to that of the D-TFT and by setting the channel width of the L-TFT to be 4 times as long as that of the D-TFT.

In addition, the capacitance value of the capacitor C is set to be 3 times or more as large as the total sum of the parasitic capacitances such as the overlap capacitance regarding the L-TFT and the D-TFT.

Next, referring to a timing chart illustrated in FIG. 2, operations according to this example will be described.

First, during the period T1 in which a signal of the scan line SL is set to an H level (current writing period: first period), the TFT3, the TFT4, and the TFT5 are turned on. During the period T1, when the TFT3 is turned on, the voltage at the source terminals of the L-TFT and the D-TFT and the voltage Vb at the anode terminal of the organic EL device LED are the same as the voltage of the ground line GND through the TFT3. On the other hand, when the TFT4 and the TFT5 are turned on, a current which is 4 times as much as the current to be supplied to the organic EL device LED is supplied from the data line DL to the drain terminal of the L-TFT through the TFT4. As a result, the voltage Va at the gate terminal is set as a voltage at which the current 4 times as the current to be supplied to the organic EL device LED flows between the drain terminal and the source terminal of the L-TFT. At the same time, between the drain terminal and the source terminal of the D-TFT, ¼ of the current from the data line DL, that is, the current to be supplied to the organic EL device LED flows. On the other hand, the voltage Vb at the anode terminal of the organic EL device LED is at the same potential as that of the voltage of the ground line GND. Accordingly, the current flowing through the D-TFT does not flow through the organic EL device LED, but entirely flows toward the ground line GND through the TFT3.

Next, during the period T2 in which the signal of the scan line SL is set to a L level (LED driving period which corresponds to light emitting period: second period), the TFT3, the TFT4, and the TFT5 are turned off. During the period T2, through the capacitor C, the voltage difference between the gate terminal and the source terminal of the D-TFT becomes a voltage difference set during the current writing period T1. In other words, the D-TFT becomes a current source for supplying the current set during the current writing period T1 from the D-TFT toward the organic EL device LED, as long as the D-TFT performs a saturation operation. Accordingly, the source terminal voltage of the D-TFT becomes such an anode terminal voltage that the current set during the current writing period T1 flows through the organic EL device LED. Then, the gate terminal voltage of the D-TFT becomes a voltage obtained by adding the voltage difference between the gate terminal and the source terminal, which is set during the current writing period T1, to the anode terminal voltage of the organic EL device LED. As a result, the organic EL device LED emits light according to the supplied current.

On the other hand, the gate terminal of the L-TFT is at the same voltage as that of the gate terminal of the D-TFT, so the voltages of the source terminal and the drain terminal of the L-TFT become the same as that of the source terminal of the D-TFT.

Hereinafter, in the organic EL display, the above-mentioned operations are repeated for each line, thereby displaying images on the display.

Therefore, according to this example, during the current writing period for supplying a current from the data line to the L-TFT, the voltages at the cathode terminal and the anode terminal of the organic EL device LED become the same, so no current flows therethrough. In addition, the voltage between the gate terminal and the source terminal at which the current supplied from the data line flows is retained in the capacitor C for the L-TFT and the D-TFT. Also during the LED driving period, the D-TFT functions as the constant current source as long as the D-TFT operates in the saturation region. In addition, the capacitor C is sufficiently larger than the total sum of the parasitic capacitances such as the overlap capacitance regarding the L-TFT and the D-TFT. Accordingly, it is possible to ignore the effect of the parasitic capacitance even when the voltages of the source terminal, the drain terminal, and the like are fluctuated.

Further, according to this example, during the LED driving period, the voltage between the drain terminal and the source terminal of the L-TFT becomes equal to the voltage at the source terminal of the D-TFT, and voltages between the gate terminals and the source terminals of the L-TFT and the D-TFT can be set to be equal to each other. Accordingly, the same characteristic change caused by the applied voltage can be obtained in the L-TFT and the D-TFT. As a result, the change in current capability ratio between the L-TFT and the D-TFT does not appear, and the influence of the characteristic change of the L-TFT and the D-TFT can be suppressed as long as the current from the data line is written.

Further, according to this example, by setting the current capability of the L-TFT to be larger than that of the D-TFT, it is possible to make the current to be supplied from the data line to the L-TFT larger than the current supplied to the organic EL device LED by the D-TFT. As a result, the current writing period can be shortened, and application to the large and high-resolution display is possible.

Further, according to this example, during the current writing period, no current is caused to flow through the organic EL device. Accordingly, as described above, even when the current supplied from the outside is large, no large current flows through the organic EL device. In this case, it is possible to suppress degradation of the organic EL device, and there is no need to increase the voltage of the data line in order to compensate the rise of the anode terminal voltage of the organic EL device.

In addition, according to this example, as the L-TFT and the D-TFT, an n-type TFT using a semiconductor layer made of an amorphous metal oxide having a carrier density of $10^{18}$ [$cm^{-3}$] or lower and a field effect mobility of 1 [$cm^2/Vs$] or more as the channel layer is used. As a result, as compared with a case of constituting the light emitting device using an a-Si TFT or an OS TFT, the light emitting display device using the TFT capable of being formed at room temperature with less power consumption can be produced. In addition, the light emitting device has a high mobility, so it is possible to realize the high-resolution and large displays.

EXAMPLE 2

Next, Example 2 of the present invention will be described. A configuration of a light emitting display device according to this example is identical with that of Example 1. Note that this example is characterized in that the voltage of the power supply line VS is varied.

Figure 3:
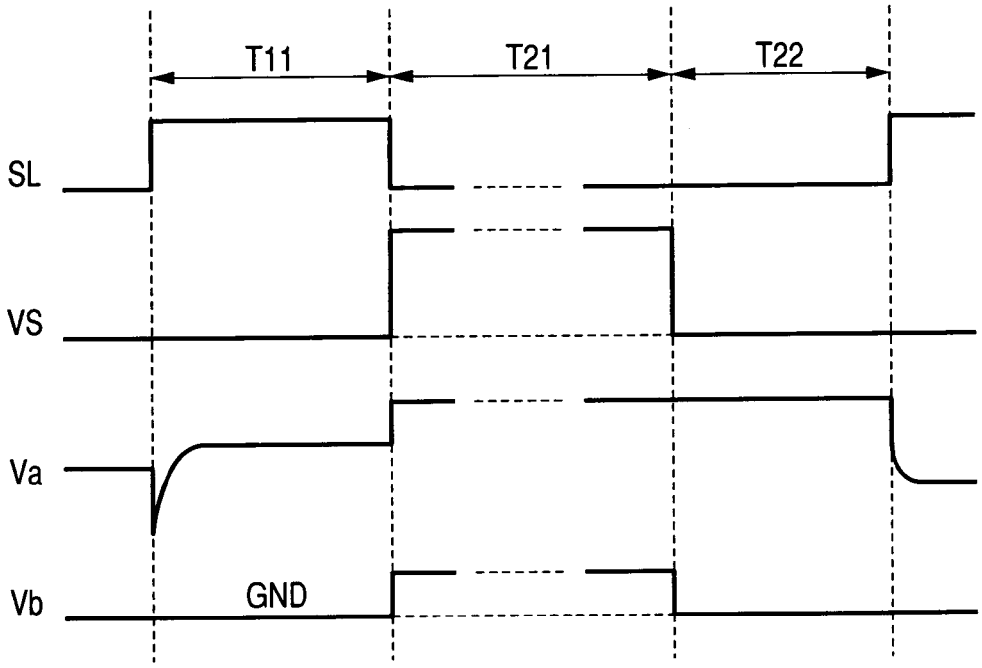
FIG. 3 is a timing chart for illustrating an operation of a light emitting display device according to Example 2 of the present invention.

Hereinafter, referring to a timing chart illustrated in FIG. 3, operations according to this example will be described.

First, in a period T11 in which the signal of the scan line SL is set to the H level, and the voltage of the power supply line VS is set to be at the same potential as the voltage of the ground line GND (hereinafter, referred to as "GND") (current writing period), the TFT3, the TFT4, and the TFT5 are turned on. During the period T11, when the TFT3 is turned on, the voltage of the source terminals of the L-TFT and the D-TFT and the voltage Vb of the anode terminal of the organic EL device LED are at the same potential as that of the voltage of the ground line GND through the TFT3. On the other hand, when the TFT4 and the TFT5 are turned on, a current which is 16 times as much as the current to be supplied to the organic EL device LED is supplied from the data line DL to the drain terminal of the L-TFT. As a result, the voltage Va of the gate terminal is set to such a voltage that the current 16 times as much as the current to be supplied to the organic EL device LED flows between the drain terminal and the source terminal of the L-TFT. On the other hand, the voltage of the power supply line VS is equal to GND, so no current flows between the drain terminal and the source terminal of the D-TFT. In addition, the voltage Vb at the anode terminal of the organic EL device LED is at the same potential as the voltage of the ground line GND, so no current flows through the organic EL device LED.

Then, there is provided a period T21 in which the signal of the scan line SL is set to a L level and the voltage of the power supply line VS is set to the voltage VD (LED driving period which corresponds to light emitting period). Note that the period T21 is set to ¼ of the LED driving period T2 of Example 1. During the period T21, the TFT3, the TFT4, and the TFT5 are turned off. In addition, through the capacitor C, the voltage difference between the gate terminal and the source terminal of the D-TFT becomes a voltage difference set during the current writing period T11. Specifically, the D-TFT becomes a current source for supplying the current set during the current writing period T11 from the D-TFT toward the organic EL device LED, that is, a current 4 times as much as the current to be supplied to the organic EL device LED, as long as the D-TFT performs a saturation operation. Accordingly, the source terminal voltage of the D-TFT becomes such an anode terminal voltage that the current set during the current writing period T11 flows through the organic EL device LED. Then, the gate terminal voltage of the D-TFT becomes a voltage obtained by adding the voltage difference between the gate terminal and the source terminal, which is set during the current writing period T1, to the anode terminal voltage of the organic EL device LED. As a result, the organic EL device LED emits light according to the supplied current.

In addition, there is provided a period T22 in which the signal of the scan line SL is set to a L level and the voltage of the power supply line VS is set to GND (dark displaying period). During the period T22, no current flows from the D-TFT, so the organic EL device LED does not emit light.

Hereinafter, in the organic EL display, the above-mentioned operations are repeated in each line, thereby displaying images on the display.

Therefore, according to this example, the same effects as those of Example 1 can be obtained. Further, in this example, a dark displaying period is provided, and the LED driving period is set to ¼ of that of Example 1, and the current flowing through the organic EL device LED is set to 4 times as much as that of Example 1. As a result, the time average luminance can be set to be substantially equal to that of Example 1. On the other hand, the current supplied from the data line becomes 4 times as much as that of Example 1, so the current writing period can be shortened, and application to a larger and higher-definition display is possible as compared with Example 1.

EXAMPLE 3

Next, Example 3 of the present invention will be described.

Figure 4:
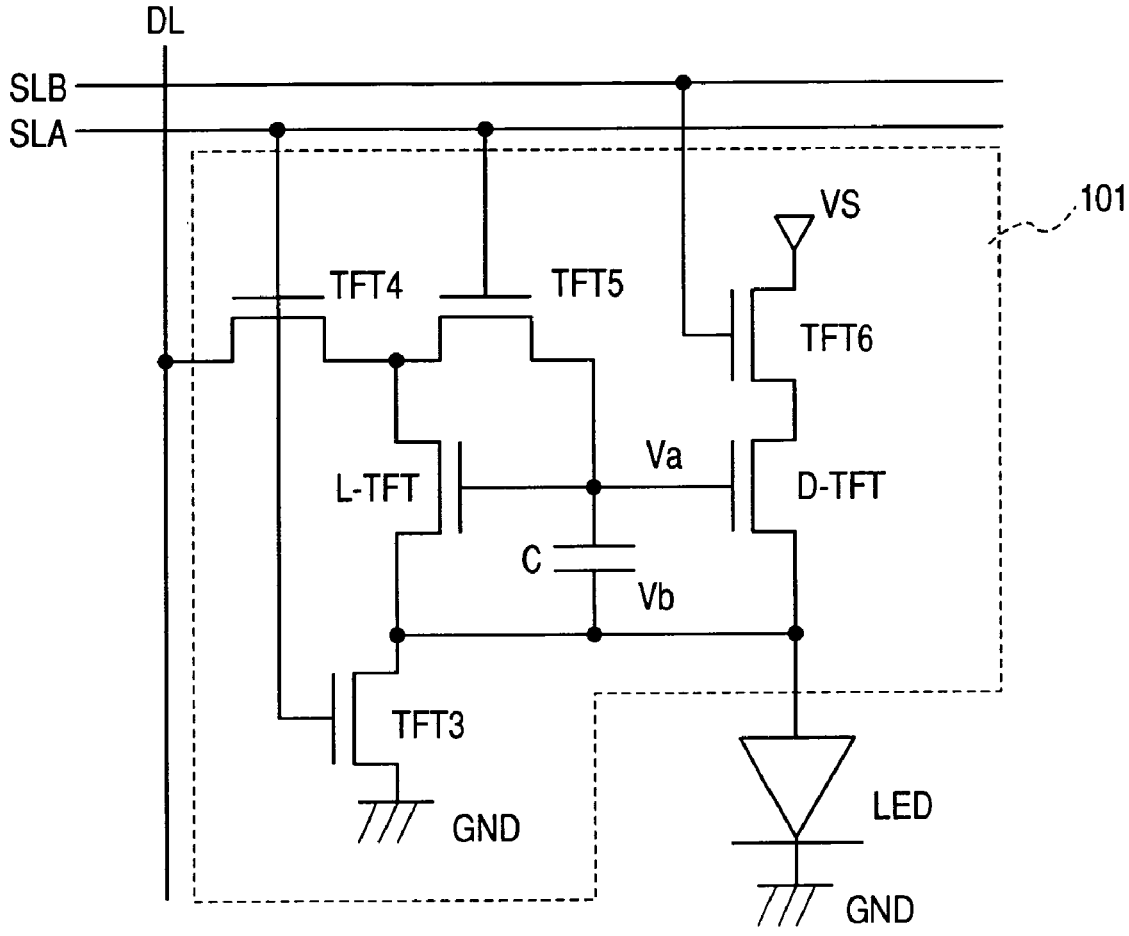
FIG. 4 is a circuit diagram for illustrating a configuration of a pixel of a light emitting display device according to Example 3 of the present invention.

A configuration of this example is illustrated in FIG. 4. A light emitting display device illustrated in FIG. 4 is an organic EL display device (AM-type organic display) including pixels each having an organic EL device LED having a cathode terminal connected (grounded) to a ground line GND, and a drive circuit 101 for driving the organic EL device LED.

In the organic EL device LED, an anode electrode, an organic material light emitting layer, and a cathode electrode are laminated in the stated order from the bottom.

The drive circuit 101 includes a first n-type TFT (hereinafter, referred to as "L-TFT"), a second n-type TFT (hereinafter, referred to as "D-TFT"), a third n-type TFT (hereinafter, referred to as "TFT3"), a fourth n-type TFT (hereinafter, referred to as "TFT4"), and a fifth n-type TFT (hereinafter, referred to as "TFT5"). In addition, the drive circuit 101 includes a sixth n-type TFT (which corresponds to sixth thin film transistor; hereinafter, referred to as "TFT6"), and a capacitor C. The L-TFT and the D-TFT are each formed of an n-type TFT (n-type current mirror TFT) forming a current mirror, and the TFT3, the TFT4, the TFT5, and the TFT6 are each formed of an n-type TFT (n-type switching TFT) forming a switching element (switch).

In the drive circuit 101, there are arranged a data line DL for supplying a current, which corresponds to display gradation of a pixel, to the L-TFT, and a first scan line SLA connected to each gate terminal of the TFT3, the TFT4, and the TFT5. In addition, in the drive circuit 101, there are provided lines such as a second scan line SLB connected to the gate terminal of the TFT6, a power supply line VS, and the ground line GND. The ground line GND corresponds to the first line of the present invention, the data line DL corresponds to the second line of the present invention, the power supply line VS corresponds to the third line of the present invention, and the first scan line SLA and the second scan line SLB correspond to the fourth and fifth line of the present invention, respectively.

The L-TFT has a source terminal connected to the anode terminal of the organic EL device LED and a gate terminal connected to one end of the capacitor C. The L-TFT corresponds to the first thin film transistor forming a current mirror circuit of the present invention.

The D-TFT has a source terminal connected to the anode terminal of the organic EL device LED and a gate terminal connected to one end of a capacitor C. The D-TFT corresponds to the second thin film transistor forming a current mirror circuit of the present invention.

The TFT3 has source and drain terminals, one of the source and drain terminals being connected to the anode terminal of the organic EL device LED, and the other of the source and drain terminals being connected (grounded) to the ground line GND. The TFT3 corresponds to the first switch of the present invention.

The TFT4 has source and drain terminals, one of the source and drain terminals being connected to the data line DL, and the other of the source and drain terminals being connected to the drain terminal of the L-TFT. The TFT4 corresponds to the second switch of the present invention.

The TFT5 has source and drain terminals, one of the source and drain terminals being connected to the drain terminal of the L-TFT, and the other of the source and drain terminals being connected to the gate terminal of the L-TFT. The TFT5 corresponds to the third switch of the present invention.

The TFT6 has source and drain terminals, one of the source and drain terminals being connected to the drain terminal of the D-TFT, and the other of the source and drain terminals being connected to the power supply line VS. The TFT6 corresponds to the fourth switch of the present invention.

The capacitor C has one end connected to the gate terminals of the L-TFT and the D-TFT and the other end connected to the source terminals of the L-TFT and the D-TFT. In addition, the other end of the capacitor C is connected to the anode terminal of the organic EL device LED.

In this case, the voltage of the power supply line VS is set to the voltage VD at which the D-TFT operates in the saturation region even in a case where the current written during the current writing period to be described later is caused to flow through the D-TFT and the organic EL device LED.

Further, the current capability of the L-TFT is assumed to be 4 times as large as that of the D-TFT, which can be realized by setting the channel length of the L-TFT to be equal to that of the D-TFT and by setting the channel width of the L-TFT to be 4 times as long as that of the D-TFT.

In addition, the capacitance value of the capacitor C is set to be 3 times or more as large as the total sum of the parasitic capacitances such as the overlap capacitance regarding the L-TFT and the D-TFT.

Figure 5:
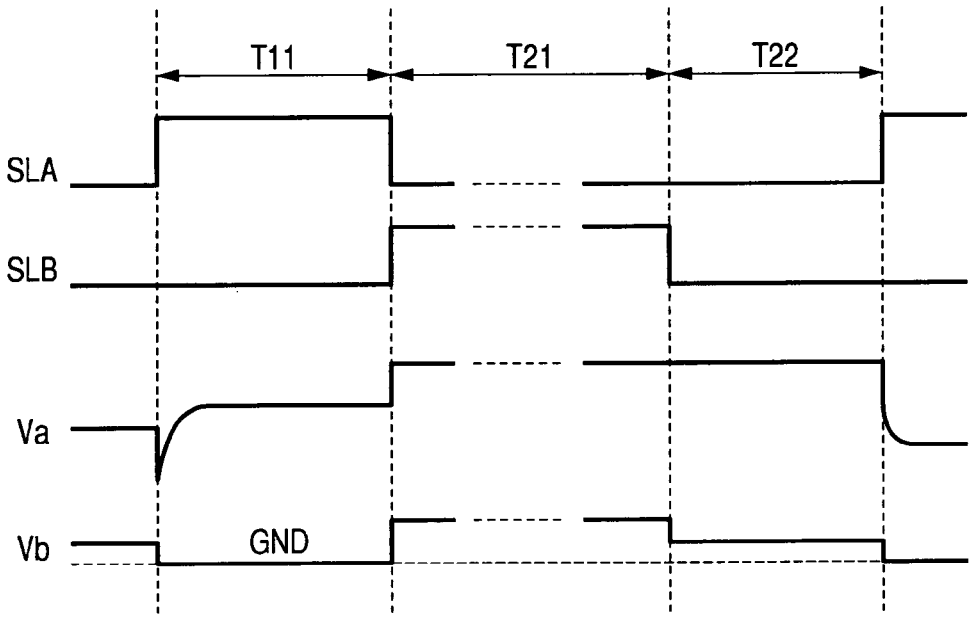
FIG. 5 is a timing chart for illustrating the operation of the light emitting display device according to Example 3.
Figure 6:
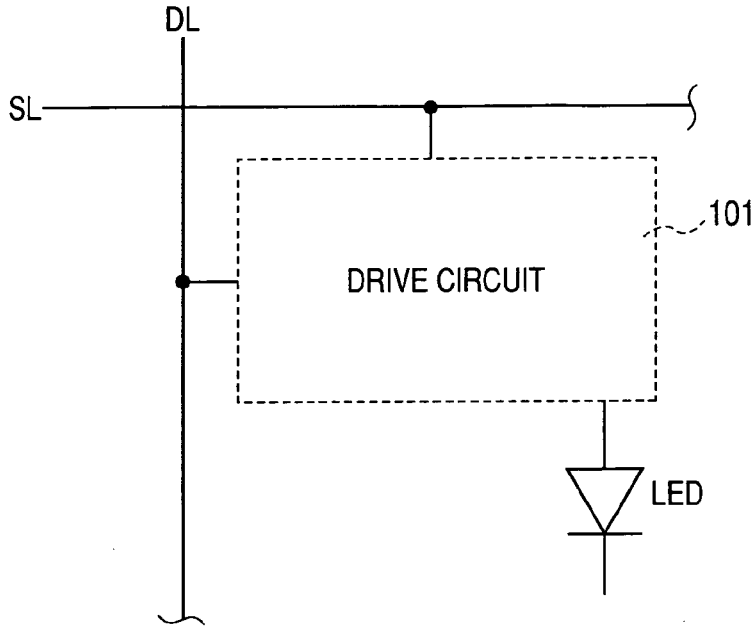
FIG. 6 is a diagram for illustrating a configuration of a pixel.
Figure 7:
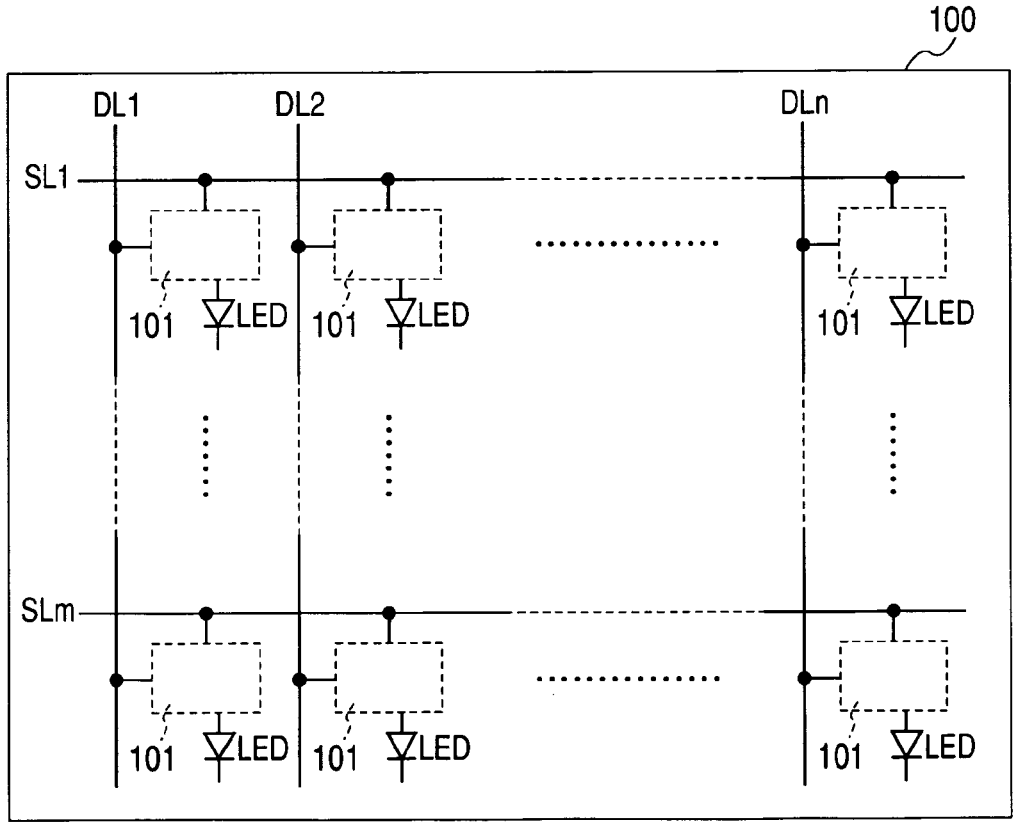
FIG. 7 is a diagram for illustrating a configuration of an organic EL display device.
Figure 8:
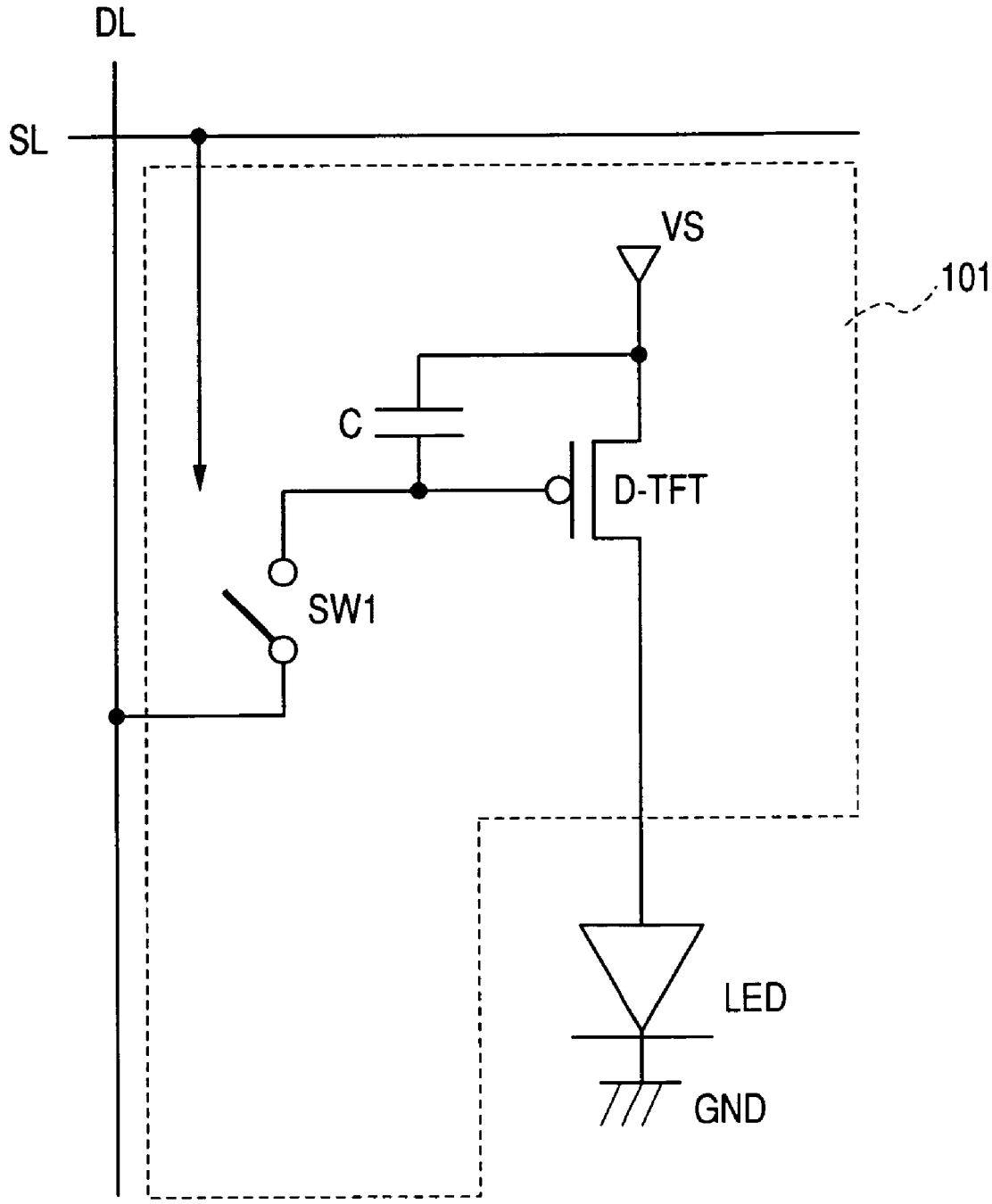
FIG. 8 PRIOR ART
FIG. 8 is a circuit diagram for illustrating a configuration of a pixel according to a first prior art example.
Figure 9:
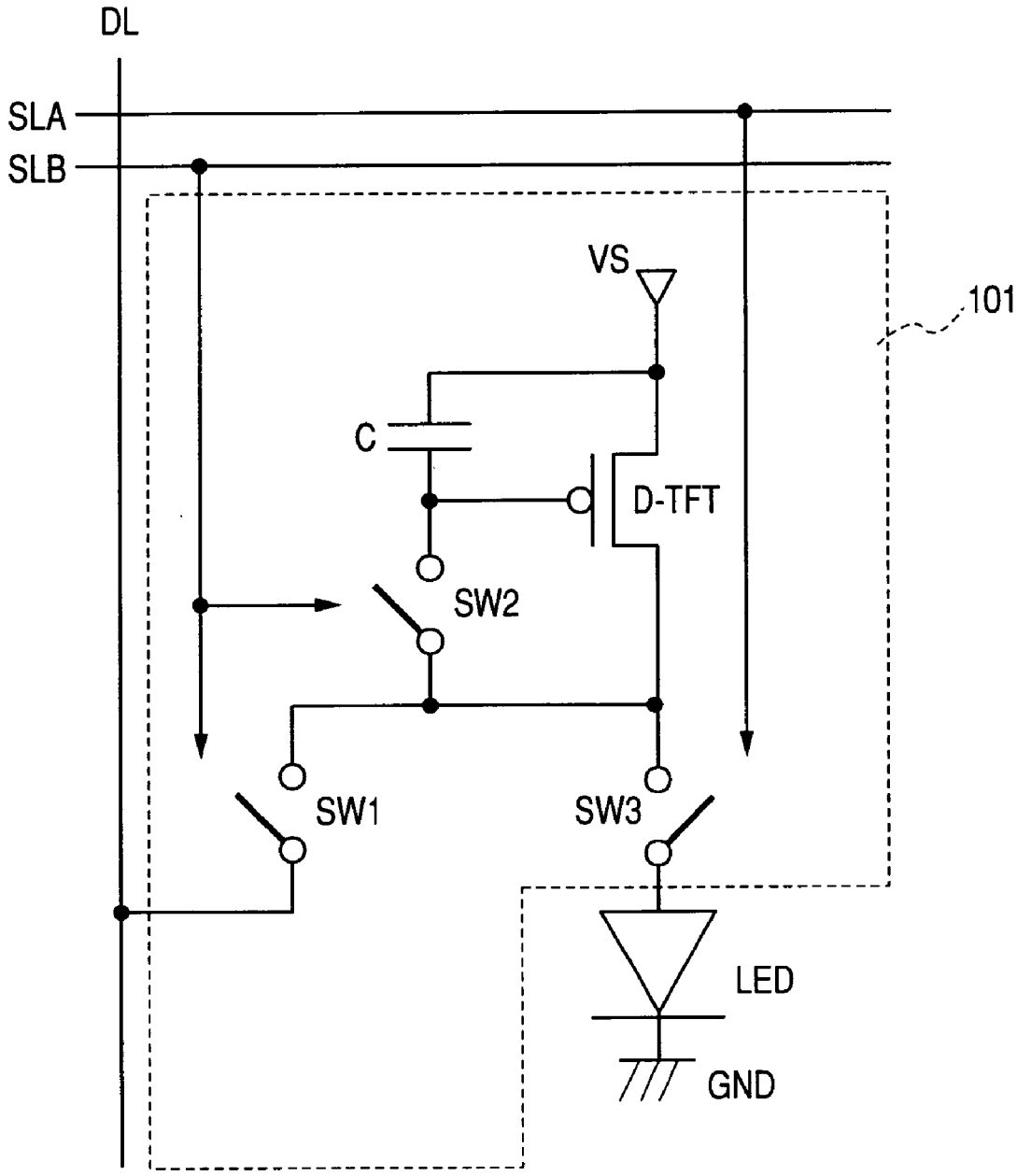
FIG. 9 PRIOR ART
FIG. 9 is a circuit diagram for illustrating a configuration of a pixel according to a second prior art example.
Figure 10:
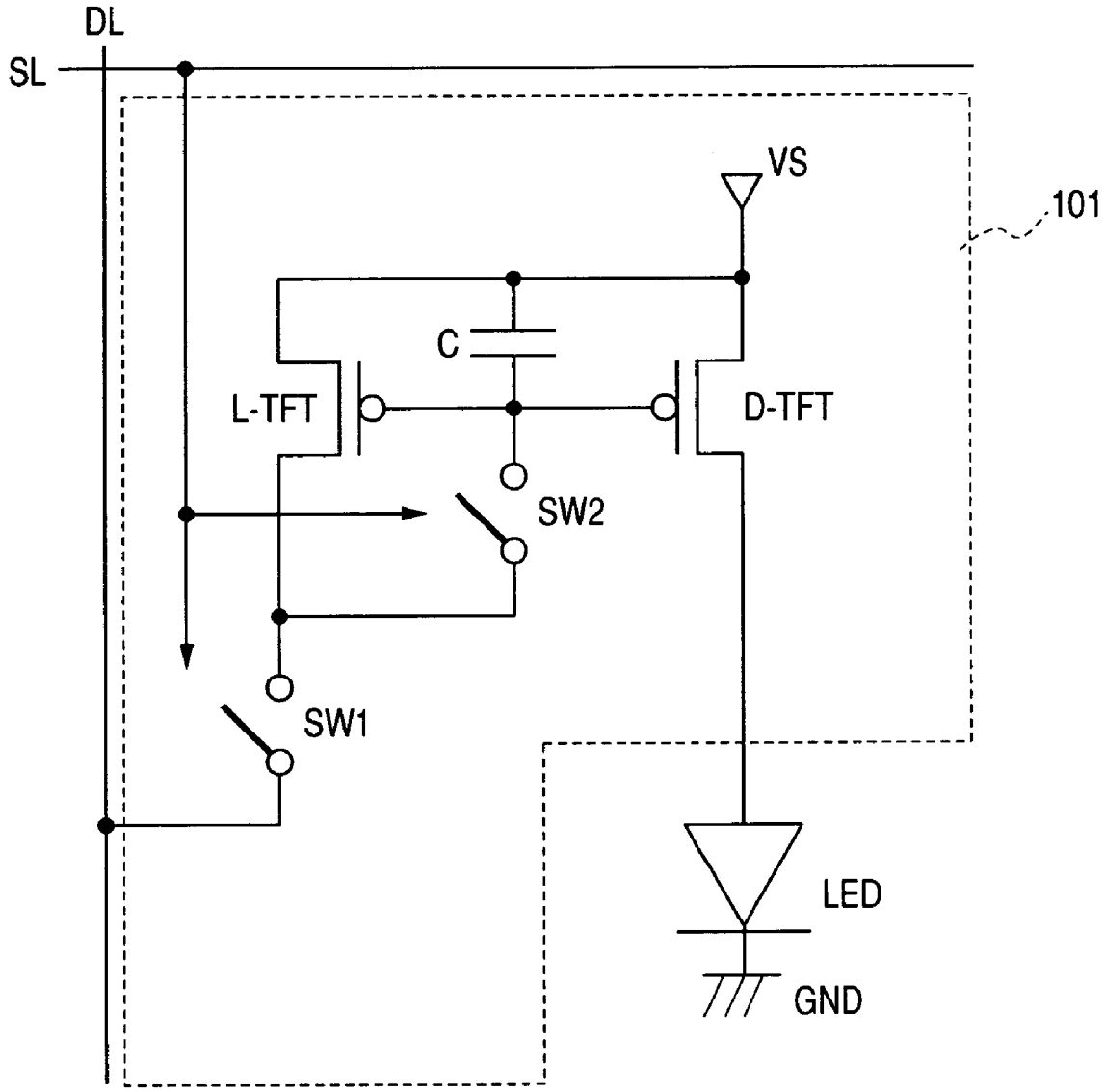
FIG. 10 PRIOR ART
FIG. 10 is a circuit diagram for illustrating a configuration of a pixel according to a third prior art example.
Figure 11:
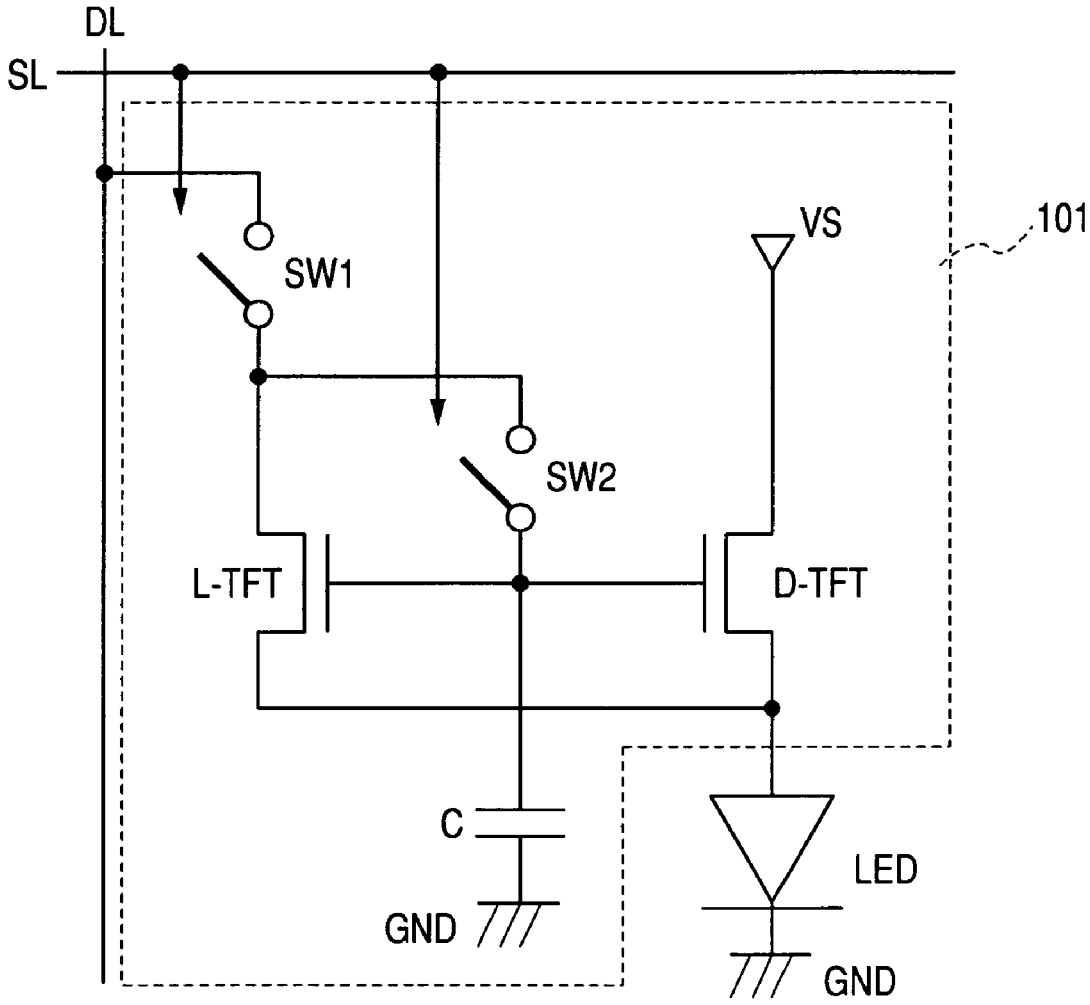
FIG. 11 PRIOR ART
FIG. 11 is a circuit diagram for illustrating a configuration of a pixel according to a fourth prior art example.

Next, referring to a timing chart illustrated in FIG. 5, operations according to this example will be described.

First, during a period T11 in which a signal of the scan line SLA is set to a H level, and a signal of the second scan line SLB is set to a L level (current writing period), the TFT3, the TFT4, and the TFT5 are turned on and the TFT6 is turned off. During the period T11, the TFT3 is turned on, so the voltage of the source terminals of the L-TFT and the D-TFT and the voltage Vb of the anode terminal of the organic EL device LED are at the same potential as that of the voltage of the ground line GND. On the other hand, the TFT4 and the TFT5 are turned on, so the current which is 16 times as much as the current to be supplied to the organic EL device LED is supplied from the data line DL to the drain terminal of the L-TFT. As a result, the voltage Va of the gate terminal is set to such a voltage that the current 4 times as much as the current to be supplied to the organic EL device LED flows between the drain terminal and the source terminal of the L-TFT. On the other hand, between the drain terminal and the source terminal of the D-TFT, the TFT6 is turned off, so a current path between the power supply line VS is interrupted, and thus no current flows. Further, the voltage of the anode terminal of the organic EL device LED and the voltage of the ground line GND are at the same potential, so no current flows through the organic EL device LED.

Next, there is provided a period T21 in which the signal of the first scan line SLA is set to a L level and the signal of the second scan line SLB is set to a H level (LED driving period which corresponds to light emitting period). Note that the period T21 is set to ¼ of the LED driving period T2 of Example 1. During the period T21, the TFT3, the TFT4, the TFT5 are turned off, and the TFT6 is turned on. In addition, through the capacitor C, the voltage difference between the gate terminal and the source terminal of the D-TFT becomes a voltage difference set during the current writing period T11. In other words, as long as the D-TFT performs a saturation operation, the D-TFT becomes a current source for supplying the current set during the current writing period T11 from the D-TFT toward the organic EL device LED, that is, the current 4 times as much as the current to be supplied to the organic EL device LED. Accordingly, the source terminal voltage of the D-TFT becomes such an anode terminal voltage that the current set during the current writing period T11 flows through the organic EL device LED. Then, the gate terminal voltage of the D-TFT becomes a voltage obtained by adding the voltage difference between the gate terminal and the source terminal, which is set during the current writing period T1, to the anode terminal voltage of the organic EL device LED. As a result, the organic EL device LED emits light according to the supplied current.

In addition, there is provided a period T22 in which the signal of the first scan line SLA is set to a L level and the signal of the second scan line SLB is set to a L level (dark displaying period). During the period T22, the TFT6 is turned off, and the current path between the power supply line VS and the drain terminal of the D-TFT is interrupted, so no current flows from the D-TFT, so the organic EL device LED does not emit light.

Hereinafter, in the organic EL display, the above-mentioned operations are repeated in each line, thereby displaying images on the display.

In this example, by adding the signal line SLB and the TFT6, it is possible to achieve the effects of Example 2 without varying the voltage supply VS.

It should be noted that in Examples 1 to 3, the current capability ratio between the L-TFT and the D-TFT is set to '4', but the current capability ratio between the L-TFT and the D-TFT can be set according to the current-luminance characteristics of the organic EL device LED and the load capacitance of the data line DL.

Further, in Examples 2 and 3, the LED driving period is set to ¼ of the LED driving period of Example 1. Although the LED driving period of Example 1 is shortened, it is possible to obtain the same effects even though the degrees of the effects somewhat vary.

Further, in Examples 1 to 3, the organic EL device LED has the cathode terminal grounded, and all the TFTs are formed of the n-type TFT (n-type thin film transistor). In a case of constituting the organic EL device LED with only the p-type TFT (p-type thin film transistor), the following configuration may be adopted.

The anode terminal of the organic EL device LED is connected to the power supply line VS, and the source terminals of p-type current mirror TFTs (first and second p-type thin film transistors of L-TFT and D-TFT) are connected to the cathode terminal of the organic EL device LED. A p-type TFT (TFT3) is provided between the source terminals of the L-TFT and the D-TFT and the power supply line VS. A p-type TFT (TFT4) is provided between the drain terminal of the L-TFT and the line DL for supplying the current corresponding to the gradation. A p-type TFT (TFT5) is provided between the drain terminal and the gate terminal of the L-TFT. The drain terminal of the D-TFT is connected to the power supply line to which the voltage GND is applied. Alternatively, the drain terminal of the D-TFT is connected to the power supply to which the voltage GND can be applied during the LED driving period and the voltage VS can be applied during the other period. More alternatively, the drain terminal of the D-TFT is connected to the power supply line to which the voltage GND is applied through the p-type TFT (TFT6). Then, the signals of the scan lines SL, SLA, and SLB are inverted. Thus, the same configuration as in Examples 1 to 3 can be realized and the same effects can be obtained.

Further, by adding the scan line in Examples 1 to 3, the TFT5 is caused to operate from the ON state to the OFF state earliest among the TFTs which fulfill a switching function at the end of the first period. As a result, noise caused in association with operations of the other TFTs which fulfill the switching operation can be suppressed, and drive can be performed with high accuracy.

The present invention can be applied not only to a light emitting display device using an organic EL device, but also to a light emitting display device using a light emitting device other than the organic EL device, which emits light with a supplied current, and to a typical current load device using a current load which represents an arbitrary function by a supplied current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-240257, filed Sep. 5, 2006, which is hereby incorporated by reference herein in its entirety.

The invention claimed is:

1. A light emitting display device comprising a pixel having a light emitting device and a drive circuit for driving the light emitting device, the drive circuit comprising:

a first thin film transistor and a second thin film transistor having the same polarity, a gate terminal of the first thin film transistor being connected to a gate terminal of the second thin film transistor, a source terminal of the first thin film transistor being connected to a source terminal of the second thin film transistor, and the source terminals of the first thin film transistor and the second thin film transistor being connected to one end of the light emitting device;

a first switch having one end connected to the source terminals of the first thin film transistor and the second thin film transistor and to one end of the light emitting device and having the other end connected to a first line; and a capacitor having one end connected to the gate terminals of the first thin film transistor and the second thin film transistor and having the other end connected to the source terminals of the first thin film transistor and the second thin film transistor, wherein the drive circuit has at least a first period for writing a drive signal and a second period for driving the light emitting device after the first period, wherein the first period contains a period in which the first line and the one end of the light emitting device are set to the same voltage through the first switch, and a second line for supplying the drive signal of the light emitting device is electrically connected to a drain terminal of the first thin film transistor and the gate terminals of the first thin film transistor and the second thin film transistor, to supply a current to the first thin film transistor from the second line, wherein the second period contains a period in which connection between the second line and the first thin film transistor, connection between the second line and the second thin film transistor, and the first switch are shut off, and wherein the capacitor has a capacitance value which is three times or more as large as a total capacitance value obtained by adding a channel capacitance and a gate and drain overlap capacitance of the first thin film transistor and a channel capacitance and a gate and drain overlap capacitance of the second thin film transistor.

2. The light emitting display device according to claim 1, wherein a value obtained by dividing a channel width of the first thin film transistor by a channel length thereof is equal to or larger than a value obtained by dividing a channel width of the second thin film transistor by a channel length thereof.

3. The light emitting display device according to claim 1, wherein the first thin film transistor and the second thin film transistor are each comprised of a p-type thin film transistor; and wherein a cathode terminal of the light emitting device is connected to the source terminals of the first p-type thin film transistor and the second p-type thin film transistor.

4. The light emitting display device according to claim 1, wherein the first thin film transistor and the second thin film transistors are each comprised of an n-type thin film transistor; and wherein an anode terminal of the light emitting device is connected to the source terminals of the first thin film transistor and the second thin film transistor.

5. The light emitting display device according to claim 4, wherein the n-type thin film transistor of the drive circuit uses an n-type semiconductor film made of an amorphous metal oxide having a carrier density of $10^{18}$ [$cm^{-3}$] or less, as a channel film of the n-type thin film transistor, and has a mobility of 1 $\mu m^2/Vs$] or more and an on/off ratio of $10^6$ or more.

6. The light emitting display device according to claim 1, wherein a voltage which is equal to or lower than a working voltage of the light emitting device is applied to the first line.

7. The light emitting display device according to claim 1, wherein the light emitting device is an organic EL device.

8. The light emitting display device according to claim 1, wherein a plurality of the pixels are arranged on a substrate in a matrix form.

9. A light emitting display device comprising a pixel having a light emitting device and a drive circuit for driving the light emitting device, the drive circuit comprising:

a first thin film transistor and a second thin film transistor having the same polarity, a gate terminal of the first thin film transistor being connected to a gate terminal of the second thin film transistor, a source terminal of the first thin film transistor being connected to a source terminal of the second thin film transistor, and the source terminals of the first thin film transistor and the second thin film transistor being connected to one end of the light emitting device;

a first switch having one end connected to the source terminals of the first thin film transistor and the second thin film transistor and to one end of the light emitting device and having the other end connected to a first line; and a capacitor having one end connected to the gate terminals of the first thin film transistor and the second thin film transistor and having the other end connected to the source terminals of the first thin film transistor and the second thin film transistor, wherein the drive circuit has at least a first period for writing a drive signal and a second period for driving the light emitting device after the first period, wherein, during the first period, the first line and one end of the light emitting device are set to the same voltage through the first switch, and a current from a second line for supplying the drive signal of the light emitting device is supplied to a drain terminal of the first thin film transistor and the gate terminals of the first thin film transistor and the second thin film transistor to retain in the capacitor a voltage between the gate terminal and the source terminal of the second thin film transistor which is determined based on a current flowing between the drain terminal and the source terminal of the first thin film transistor, wherein, during the second period, a current flowing between the source terminal and the drain terminal of the second thin film transistor is supplied to the light emitting device according to a retaining voltage of the capacitor, and wherein the capacitor has a capacitance value which is three times or more as large as a total capacitance value obtained by adding a channel capacitance and a gate and drain overlap capacitance of the first thin film transistor and a channel capacitance and a gate and drain overlap capacitance of the second thin film transistor.

10. The light emitting display device according to claim 9, wherein the drive circuit further comprises:

a second switch having one end connected to the second line and having the other end connected to the drain terminal of the first thin film transistor; and a third switch having one end connected to the drain terminal of the first thin film transistor and having the other end connected to the gate terminal of the first thin film transistor; and wherein the current from the second line is supplied to the drain terminal of the first thin film transistor and to the gate terminals of the first thin film transistor and the second thin film transistor through the second and third switches.

11. The light emitting display device according to claim 10, wherein the drive circuit further comprises a fourth switch between a third line and the drain terminal of the second thin film transistor.

12. The light emitting display device according to claim 11, wherein the first switch, the second switch, the third switch, and the fourth switch are respectively comprised of a third thin film transistor, a fourth thin film transistor, a fifth thin film transistor, and a sixth thin film transistor; and wherein the third thin film transistor, the fourth thin film transistor, the fifth thin film transistor, and the sixth thin film transistor have the same polarity as that of the first thin film transistor and the second thin film transistor.

13. The light emitting display device according to claim 12, wherein the third thin film transistor, the fourth thin film transistor, and the fifth thin film transistor, respectively corresponding to the first switch, the second switch, and the third switch each have a gate terminal connected to a fourth line.

14. The light emitting display device according to claim 11, wherein the drive circuit further comprises a current breaker which does not allow a current to flow between the source terminal and the drain terminal of the second thin film transistor in a part of at least one of the first period and the second period.

15. The light emitting display device according to claim 14, wherein the current breaker sets a voltage at the drain terminal of the second thin film transistor to the same potential as that of a voltage of the first line.

16. The light emitting display device according to claim 14, wherein the current breaker interrupts a current path of the second thin film transistor with the fourth switch.

* * * * *